United States Patent [19]

Cavallaro

[11] Patent Number: 4,618,574

[45] Date of Patent: Oct. 21, 1986

[54] HIGH CONTRAST PHOTOGRAPHIC ELEMENTS EXHIBITING REDUCED PEPPER FOG

[75] Inventor: Anthony Cavallaro, East Rochester, N.Y.

[73] Assignee: Eastman Kodak Company, Rochester, N.Y.

[21] Appl. No.: 756,158

[22] Filed: Jul. 18, 1985

[51] Int. Cl.[4] ..... G03C 1/34

[52] U.S. Cl. ..... 430/567; 430/631; 430/605; 430/603; 430/570; 430/611; 430/607; 430/599; 430/564

[58] Field of Search ..... 430/611, 567, 631, 605, 430/603, 570, 607, 599, 564, 614

[56] References Cited

U.S. PATENT DOCUMENTS

| | | | |
|---|---|---|---|
| 2,419,975 | 5/1947 | Trivelli et al. | 430/441 |
| 3,081,170 | 3/1963 | Rauch et al. | 430/611 |
| 3,236,652 | 2/1966 | Kennard et al. | 430/607 |
| 3,730,724 | 5/1973 | Abbott et al. | 430/505 |
| 4,138,265 | 2/1979 | Shiao | 430/565 |
| 4,272,606 | 6/1981 | Mifune et al. | 430/264 |
| 4,332,878 | 6/1982 | Akimura et al. | 430/264 |
| 4,377,634 | 3/1983 | Mifune et al. | 430/442 |
| 4,385,108 | 5/1983 | Takagi et al. | 430/264 |
| 4,560,638 | 12/1985 | Loblaw et al. | 430/264 |

FOREIGN PATENT DOCUMENTS

| | | | |
|---|---|---|---|
| 3223699 | 12/1983 | Fed. Rep. of Germany | 430/607 |

OTHER PUBLICATIONS

*Research Disclosure,* vol. 235, Nov. 1983, Item 23510.

*Research Disclosure,* vol. 176, Dec. 1978, Item 17643, Section VI.

James, *The Theory of the Photographic Process,* 4th Ed., Macmillan, Chapter 13, Section J., Antifoggants and Stabilizers, p. 396.

*Primary Examiner*—Won H. Louie

*Attorney, Agent, or Firm*—Thomas F. Kirchoff

[57] ABSTRACT

A negative working photographic element is disclosed capable of producing a high contrast silver image. The photographic element is comprised of surface latent image forming monodispersed silver halide grains having a mean diameter of less than 0.7 μm, a contrast enhancing arylhydrazide, and, in an amount sufficient to reduce pepper fog while maintaining high contrast a polyhydroxybenzene and a carboxyalkyl-3H-thiazoline-2-thione.

18 Claims, 2 Drawing Figures

FIG. 2

HIGH CONTRAST PHOTOGRAPHIC ELEMENTS EXHIBITING REDUCED PEPPER FOG

FIELD OF THE INVENTION

This invention relates to negative working silver halide photographic elements capable of producing high contrast silver images. More specifically, this invention relates to photographic elements containing an arylhydrazide to increase contrast.

BACKGROUND OF THE INVENTION

It is often desirable to produce black-and-white photographic images formed by a combination of maximum density areas and minimum density areas. For such imaging applications a contrast of at least 10 (herein referred to as high contrast) and more typically near or above 20 is employed. An example of high contrast photographic elements having white reflective supports are phototypesetting materials intended to produce black type character images on a white background. An example of high contrast photographic elements having transparent supports are lith films, so called because they are used as contact transparencies for exposing lithographic printing plates. The illusion that some areas of a printed image are of intermediate density is created by the viewer's inability to resolve tiny dots of maximum density and background areas of minimum density that separate them. Such images are referred to as halftone images.

The use of hydrazines in negative working surface latent image forming silver halide emulsions and photographic elements to increase speed and contrast is taught by the following patent:

R-1: Trivelli et al U.S. Pat. No. 2,419,975. Increased contrast attributable to hydrazines in negative working surface latent image forming silver halide emulsions is believed to result from the promotion of infectious development. The hydrazines preferred for their higher effectiveness in increasing contrast are arylhydrazides. The acyl moiety of arylhydrazides increases activity while the aryl moiety acts to increase stability. A patent literature summary of arylhydrazides employed to increase contrast in negative working silver halide emulsions, including a discussion of the mechanism of activity, is provided by the following publication:

R-2: *Research Disclosure,* Vol. 235, November 1983, Item 23510. *Research Disclosure* is published by Kenneth Mason Publications, Ltd., Emsworth, Hampshire P010 7DD, England.

In surface latent image forming silver halide emulsions the grains which are exposed to light are rendered developable while grains which are not exposed to light are not intended to be developed. Nevertheless, some of these unexposed grains develop spontaneously. In fulltone imaging the spontaneously developing grains raise minimum density more or less uniformly. Such minimum density levels are referred to as fog and, so long as they remain low, are not objectionable.

Pepper fog differs from ordinary fog in that it takes the form of small, maximum density areas randomly distributed on a substantially uniform minimum density background. When a photographic element exhibiting pepper fog is viewed under magnification, the impression to the viewer is often that the magnified field of view has been sprinkled with grains of pepper. It has been long recognized that arylhydrazides produce pepper fog, and, until recently, this has interfered with the commercial use of arylhydrazides in halftone imaging. An illustration of severe pepper fog appears in FIG. 1.

Reduction of pepper fog as well as improved halftone imaging by employing an arylhydrazide that is substituted at its aryl moiety by an oxycarbamido, thiocarbamido, carbamoyloxy, or carbamoylthio group is disclosed in the following patent:

R-3: Loblaw et al U.S. Pat. No. 4,560,638. The incorporation of developing agents, such as hydroquinones, is also taught by R-3.

Thiazoline-2-thiones are known to be useful in photographic materials. Thiazoline-2-thiones which are N-substituted to prevent enolization are taught to be useful antifoggants, as illustrated by the following patent:

R-4: Rauch et al U.S. Pat. No. 3,081,170. Thiazoline-2-thiones which are N-substituted to prevent enolization are taught to be useful antifoggants in negative working photographic elements employing an arylhydrazide to achieve high contrast, as illustrated by the following patent:

R-5: Mifune et al U.S. Pat. No. 4,272,606. Carboxyalkyl-3H-thiazoline-2-thiones are disclosed to be useful antifoggants in dye enhanced photothermographic imaging systems, as illustrated by the following patent:

R-6: Shiao U.S. Pat. No. 4,138,265. Carboxyalkyl-3H-thiazoline-2-thiones are also disclosed to be useful in preserving color balance in multicolor photographic elements, as illustrated by the following patent:

R-7: Abbott et al U.S. Pat. No. 3,730,724.

R-8: James, *The Theory of the Photographic Process,* 4th Ed., Macmillan, Chapter 13, Section J. Antifoggants and Stabilizers, p. 396, states > *Antifoggants* or fog restrainers are agents that decrease the rate of fog density growth during development to a greater degree than they decrease the rate of image growth. *Stabilizers* are agents that decrease the changes in developable fog and/or in other sensitometric characteristics of the emulsion coating that occur during storage (aging). Some agents act in both capacities; others may act in only one capacity, or their action may be restricted to particular types of fog development or aging changes or both. Their quantitative, and sometimes their qualitative action depends upon the concentration as well as the chemical composition of the agents.

Thus, in assessing antifoggants and stabilizers it is important to note that stabilization and antifogging activity are sometimes both in evidence; however, stabilization and antifogging effects are independent and observations of utility for either purpose are valid only for the type of the photographic system employed. This is further illustrated by the following publication cataloguing a variety of known antifoggants and/or stabilizers, wherein the addenda and the photographic systems in which they are observed to be useful are correlated:

R-9: *Research Disclosure,* Vol. 176, December 1978, item 17643, Section VI.

Photographic elements employing an arylhydrazide to achieve high contrast have additionally had hydroquinone incorporated therein for varied purposes. The incorporation of hydroquinones in concentrations of from $5\times10^{-2}$ to 5 mole/Ag mole to act as developing agents is taught in the following patent:

R-10: Takagi et al U.S. Pat. No. 4,385,108. The incorporation of indazole substituted hydroquinones to improve dot quality and screen range in halftone imaging is taught in the following patent:

R-11: Akimura et al U.S. Pat. No. 4,332,878. The incorporation of substituted hydroquinones, particularly thio group substituted hydroquinones, to improve speed and contrast and therefore halftone imaging characteristics, is disclosed by the following patent:

R-12: Mifune et al U.S. Pat. No. 4,377,634.

The use of carboxyalkyl-3H-thiazoline-2-thiones in high contrast arylhydrazide containing photographic elements to stabilize sensitivity is taught in the following patent application:

R-13: Cavallaro U.S. Ser. No. 756,157, filed concurrently herewith and commonly assigned, titled HIGH CONTRAST PHOTOGRAPHIC ELEMENTS EXHIBITING STABILIZED SENSITIVITY.

The use of polyhydroxybenzenes in high contrast arylhydrazide containing photographic elements to reduce pressure sensitivity is taught in the following patent application:

R-14: Loblaw U.S. Ser. No. 756,113, filed concurrently herewith and commonly assigned, titled HIGH CONTRAST PHOTOGRAPHIC ELEMENTS EXHIBITING REDUCED STRESS SENSITIVITY.

SUMMARY OF THE INVENTION

In one aspect this invention is directed to a negative working photographic element capable of producing a high contrast silver image comprised of a support, a contrast enhancing arylhydrazide, and a gelatino-silver halide emulsion layer comprised of surface latent image forming monodispersed silver halide grains having a mean diameter of less than 0.7 μm. The photographic element is further characterized in that the emulsion layer contains in an amount sufficient to reduce pepper fog while maintaining high contrast a polyhydroxybenzene and a carboxyalkyl-3H-thiazoline-2-thione.

DESCRIPTION OF THE DRAWINGS

The invention can be better appreciated by reference to the following detailed description considered in conjunction with the drawings, in which FIGS. 1 and 2 are 20X enlargements of pepper fog, FIG. 1 representing an unacceptably high level of pepper fog and FIG. 2 representing a 5 rating on a rating scale of from 1 to 10, where lowest pepper fog levels are assigned a rating of 1 and the highest pepper fog levels are assigned a rating of 10.

DESCRIPTION OF PREFERRED EMBODIMENTS

Figure 1:
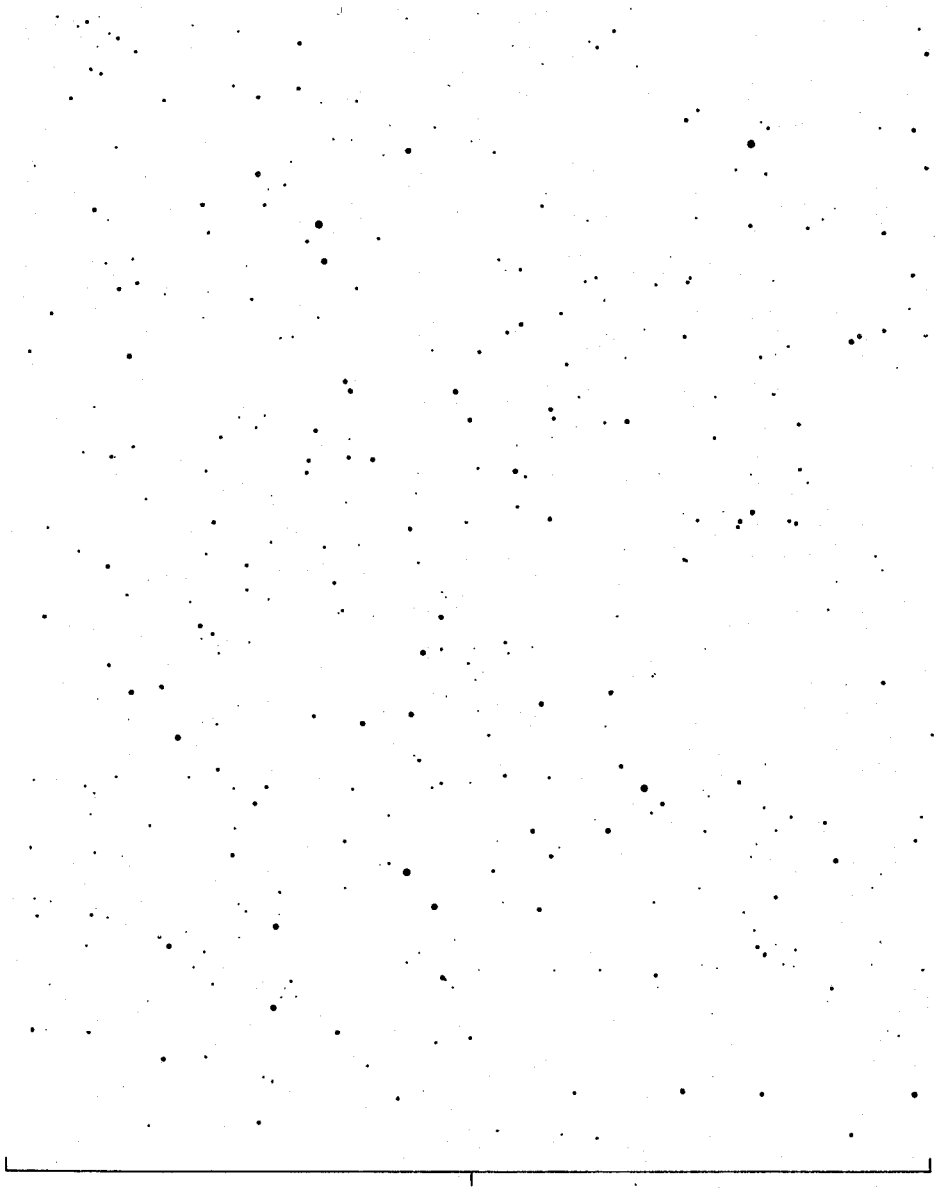

It has been observed that negative working high contrast silver image forming photographic elements of the type comprised of a contrast enhancing arylhydrazide and an emulsion layer containing surface latent image forming monodispersed silver halide grains having a mean diameter of less than 0.7 μm exhibit pepper fog.

The present invention has as one of its primary purposes to reduce pepper fog while avoiding reduction of contrast below desired high contrast levels. This is accomplished by introducing into the emulsion layer of the photographic element a polyhydroxybenzene and a carboxyalkyl-3H-thiazoline-2-thione.

Any carboxyalkyl-3H-thiazoline-2-thione can be employed. It is important that the thiazoline-2-thione be a 3H-thiazoline-2-thione. In the absence of a substituent for the ring nitrogen atom enolization is possible. Enolization is not possible when a conventional N-substituted thiazoline-2-thione antifoggant is employed.

The carboxyalkyl substituent contains an alkylene linking moiety and a carboxy moiety, which can be in the form of a free acid or a salt, such as an alkali or ammonium salt. The alkylene linking moiety preferably contains from 1 to 6 carbon atoms. A specifically preferred linking moiety is an optionally substituted linking moiety of the formula:

$$-\overset{R^a}{\underset{R^b}{C}}- \qquad (I)$$

where $R^a$ and $R^b$ are independently hydrogen or an an alkyl group. In a specifically preferred form the methylene linking group is unsubstituted and therefore of the formula:

$$-CH_2- \qquad (II)$$

Since the ring nitrogen atom is not substituted, only the 4 and 5 positions of the thiazoline ring are available for substituents. The carboxyalkyl substituent can occupy either of these two positions. The remaining position can be either unsubstituted or substituted with any one of a variety of noninterfering groups. The remaining position substituent can, for example, be an alkyl group of from 1 to 10 carbon atoms or an aryl group of from 6 to 12 carbon atoms.

Exemplary preferred carboxyalkyl-3H-thiazoline-2-thiones include

ST-1: 4-carboxymethyl-3H-thiazoline-2-thione
ST-2: 5-carboxymethyl-3H-thiazoline-2-thione
ST-3: 4-(2-carboxyethyl)-3H-thiazoline-2-thione
ST-4: 5-(3-carboxypropyl)-3H-thiazoline-2-thione
ST-5: 4-(1-carboxyethyl)-3H-thiazoline-2-thione
ST-6: 4-(1-carboxy-n-butyl)-3H-thiazoline-2-thione
ST-7: 5-(1-carboxy-n-hexyl)-3H-thiazoline-2-thione
ST-8: 4-(2-carboxy-iso-propyl)-3H- thiazoline-2-thione
ST-9: 4-carboxymethyl-5-methyl-3H-thiazoline-2-thione
ST-10: 5-carboxymethyl-4-phenyl-3H-thiazoline-2-thione The carboxyalkyl-3H-thiazoline-2-thione can be present in the emulsion layer of the photographic element in any sensitivity stabilizing amount. Concentrations of from $3\times10^{-5}$ to $3\times10^{-3}$ mole per silver mole are preferred, with concentrations of between $10^{-4}$ and $10^{-3}$ mole per silver mole being generally optimum.

The polyhydroxybenzene can most conveniently take the form of a dihydroxybenzene, such as a 1,2-dihydroxybenzene—i.e., a pyrocatechol; a 1,3-dihydroxybenzene—i.e., a resorcinol; or a 1,4-dihydroxybenzene—i.e., a hydroquinone. Benzenes having three or more hydroxy substituents, though less common, are also useful. For example, compounds such as a 1,2,3-trihydroxybenzene—i.e., a pyrogallol; a 1,3,5-trihydroxybenzene—i.e., a phloroglucinol; or a 1,2,4-trihydroxybenzene—i.e., a hydroxyhydroquinone are also contemplated.

In general the polyhydroxybenzenes can be either unsubstituted or substituted, such as, for example, with halogen, alkyl, alkoxy, amino, amido, sulfonamido, sulfo, carboxy, and similar groups. Unsubstituted polyhydroxybenzenes are preferred, since they offer the maximum activity with the least molecular bulk and hence the least tendency toward tackiness. Bulky and oleophilic substituents, such as alkyl, aryl, alkaryl, and heterocyclic groups, are useful in applications more tolerant of tackiness or in applications where other measures have been taken to reduce tackiness, but are not generally preferred. On the other hand, highly polar substituents, particularly less bulky polar substituents, such as carboxy and sulfo substituents are preferred substituents. For example, compounds such as 1-carboxy-3,4,5-trihydroxybenzene—i.e., gallic acid; the Diels-Alder adduct of hydroquinone and maleic anhydride; and 4,5-dihydroxy-1,3-benzenedisulfonic acid are compatible with the practice of the invention. The carboxy and sulfo substituents can be either in their free acid or salt form—e.g., the alkali or ammonium salt form.

The following are exemplary of contemplated polyhydroxybenzenes:

PHB-1: Hydroquinone
PHB-2: 2,5-Dichlorohydroquinone
PHB-3: 2-Methylhydroquinone
PHB-4: 2-Hydroxyhydroquinone
PHB-5: 2-Carboxyhydroquinone, sodium salt
PHB-6: 2-Sulfohydroquinone, sodium salt
PHB-7: Pyrocatechol
PHB-8: Resorcinol
PHB-9: 5-Bromoresorcinol
PHB-7: Gallic Acid
PHB-10: 4,5-Dihydroxy-1,3-benzenesulfonic acid, sodium salt
PHB-11: Phloroglucinol
PHB-12: Pyrogallol It is to be noted that the carboxyalkyl-3H-thiazoline-2-thione is capable of stabilizing emulsion sensitivity on aging independently of the presence of the polyhydroxybenzene, as taught by R-13, cited above. It is further noted that the polyhydroxybenzene is capable of reducing pressure sensitivity independently of the presence of the carboxyalkyl-3H-thiazoline-2-thione, as taught by R-14, cited above. Thus, the photographic elements of this invention, which employ a combination of polyhydroxybenzene and carboxyalkyl-3H-thiazoline-2-thione, can exhibit a combination of advantages, reduced pepper fog, reduced pressure sensitivity, and higher stability of sensitivity on aging.

As among the polyhydroxybenzenes, hydroquinones are preferred, since they are recognized to also be most active in reducing pressure sensitivity. Since phenol (monohydroxybenzene) is ineffective to reduce pressure sensitivity, it is believed that the effectiveness of polyhydroxybenzenes to reduce pressure sensitivity is related to their activity as mild reducing agents. The most active reducing agents, the 1,4-dihydroxybenzenes, are effective at concentrations below $5\times10^{-2}$ mole per silver mole and therefore need not be employed above this concentration level for the purposes of this invention. The other polyhydroxybenzenes, to the extent that they are weaker reducing agents, can be expected to offer further advantages, at least in reductions in pressure sensitivity, at higher concentration levels. However, as the polyhydroxybenzene concentration increases, the tendency toward tackiness of the emulsion layer increases. Polyhydroxybenzene concentrations are therefore preferably limited to less than $30\times10^{-2}$ mole per silver mole and optimally to less than $15\times10^{-2}$ mole per silver mole.

The carboxyalkyl-3H-thiazoline-2-thiones and polyhydroxybenzenes are incorporated in negative working photographic emulsions comprised of radiation sensitive silver halide grains capable of forming a surface latent image and a vehicle. The silver halide emulsions include the high chloride emulsions conventionally employed in forming lith photographic elements as well as silver bromide and silver bromoiodide emulsions, which are recognized in the art to be capable of attaining higher photographic speeds. Generally the iodide content of the silver halide emulsions is less than about 10 mole percent silver iodide, based on total silver halide.

The silver halide grains of the emulsions are capable of forming a surface latent image, as opposed to being of the internal latent image forming type. Surface latent image silver halide grains are employed in the overwhelming majority of negative working silver halide emulsions, whereas internal latent image forming silver halide grains, though capable of forming a negative image when developed in an internal developer, are usually employed with surface developers to form direct positive images. The distinction between surface latent image and internal latent image silver halide grains is generally well recognized in the art. Generally some additional ingredient or step is required in preparation to form silver halide grains capable of preferentially forming an internal latent image as compared to a surface latent image.

Although the difference between a negative image produced by a surface latent image emulsion and a positive image produced by an internal latent image emulsion when processed in a surface developer is a qualitative difference which is visually apparent to even the unskilled observer, a number of tests have been devised to distinguish quantitatively surface latent image forming and internal latent image forming emulsions. For example, according to one such test when the sensitivity resulting from surface development (A), described below, is greater than that resulting from internal development (B), described below, the emulsion being previously light exposed for a period of from 1 to 0.01 second, the emulsion is of a type which is "capable of forming a surface latent image" or, more succinctly, it is a surface latent image emulsion. The sensitivity is defined by the following equation:

$$S=100/Eh$$

in which S represents the sensitivity and Eh represents the quantity of exposure necessary to obtain a mean density—i.e., $\frac{1}{2}$ (D-max+D-min).

Surface Development (A)

The emulsion is processed at 20° C. for 10 minutes in a developer solution of the following composition:

| | |
|---|---|
| N—methyl-p-aminophenol hemisulfate | 2.5 g |
| Ascorbic acid | 10 g |
| Sodium metaborate (with 4 molecules of water) | 35 g |
| Potassium bromide | 1 g |
| Water to bring the total to | 1 liter. |

Internal Development (B)

The emulsion is processed at about 20° C. for 10 minutes in a bleaching solution containing 3 g of potassium ferricyanide per liter and 0.0125 g of phenosafranine per liter and washed with water for 10 minutes and developed at 20° C. for 10 minutes in a developer solution having the following composition:

| | |
|---|---|
| N—methyl-p-aminophenol hemisulfate | 2.5 g |

-continued

| | |
|---|---|
| Ascorbic acid | 10 g |
| Sodium metaborate (with 4 moles of water) | 35 g |
| Potassium bromide | 1 g |
| Sodium thiosulfate | 3 g |
| Water to bring the total to | 1 liter. |

The silver halide grains, when the emulsions are used for lith applications, have a mean grain size of not larger than about 0.7 μm, preferably about 0.4 μm or less. Mean grain size is well understood by those skilled in the art, as illustrated by Mees and James, *The Theory of the Photographic Process,* 3rd Ed., MacMillan 1966, Chapter 1, pages 36–43. The photographic emulsions of this invention are capable of producing higher photographic speeds than would be expected from their mean grain sizes. The photographic emulsions can be coated to provide emulsion layers in the photographic elements of any conventional silver coverage. Common conventional silver coating coverages fall within the range of from about 0.5 to about 10 grams per square meter.

As is generally recognized in the art, higher contrasts can be achieved by employing relatively monodispersed emulsions, particularly when larger grain size emulsions are employed. As herein employed, the term "monodispersed" is employed to indicate emulsions having a coefficient of variation of less than 40%. For the highest levels of contrast it is generally preferred that the monodispersed emulsions have a coefficient of variation of less than 20%. (As employed herein the coefficient of variation is defined as 100 times the standard deviation of the grain diameter divided by the average grain diameter.)

Silver halide emulsions contain in addition to silver halide grains a vehicle. The proportion of vehicle can be widely varied, but typically is within the range of from about 20 to 250 grams per mole of silver halide. Excessive vehicle can have the effect of reducing maximum density and consequently also reducing contrast. Thus for contrast values of 10 or more it is preferred that the vehicle be present in a concentration of 250 grams per mole of silver halide or less. The specific vehicle materials present in the emulsion and any other layers of the photographic elements can be chosen from among conventional vehicle materials. Preferred vehicles are water permeable hydrophilic colloids employed alone or in combination with extenders such as synthetic polymeric peptizers, carriers, latices, and binders. Such materials are more specifically described in *Research Disclosure,* Vol. 176, December 1978, Item 7643, Section IX. Vehicles are commonly employed with one or more hardeners, such as those described in Section X.

Emulsions contemplated include those having silver halide grains of any conventional geometric form (e.g., regular octahedral or, preferably, cubic crystalline form) can be prepared by a variety of techniques—e.g., single-jet, double-jet (including continuous removal techniques), accelerated flow rate and interrupted precipitation techniques, as illustrated by Trivelli and Smith, *The Photographic Journal,* Vol. LXXIX, May, 1939, pages 330–338; T. H. James *The Theory of the Photographic Process,* 4th Ed., Macmillan, 1977, Chapter 3; Terwilliger et al *Research Disclosure,* Vol. 149, September 1976, Item 14987; *Research Disclosure,* Vol. 225, January 1983, Item 22534; as well as Nietz et al U.S. Pat. No. 2,222,264; Wilgus German OLS No. 2,107,118; Lewis U.K. Pat. Nos. 1,335,925, 1,430,465 and 1,469,480, Irie et al U.S. Pat. No. 3,650,757; Morgan U.S. Pat. No. 3,917,485 (where pAg cycling is limited to permit surface development); and Musliner U.S. Pat. No. 3,790,387. Double-jet accelerated flow rate precipitation techniques are preferred for forming monodispersed emulsions. Sensitizing compounds, such as compounds of copper, thallium, cadmium, rhodium, tungsten, thorium, iridium and mixtures thereof, can be present during precipitation of the silver halide emulsion, as illustrated by Arnold et al U.S. Pat. No. 1,195,432; Hochstetter U.S. Pat. No. 1,951,933; Trivelli et al, U.S. Pat. No. 2,448,060; Overman U.S. Pat. No. 2,628,167; Mueller U.S. Pat. No. 2,950,972; Sidebotham U.S. Pat. No. 3,488,709; and Rosecrants et al U.S. Pat. No. 3,737,313.

The individual reactants can be added to the reaction vessel through surface or sub-surface delivery tubes by gravity feed or by delivery apparatus for maintaining control of the pH and/or pAg of the reaction vessel contents, as illustrated by Culhane et al U.S. Pat. No. 3,821,002, Oliver U.S. Pat. No. 3,031,304 and Claes et al *Photographische Korrespondenz,* Band 102, Number 10, 1967, page 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Saito et al German OLS No. 2,556,885 and Sato et al German OLS No. 2,555,365. An enclosed reaction vessel can be employed to receive and mix reactants upstream of the main reaction vessel, as illustrated by Forster et al U.S. Pat. No. 3,897,935 and Posse et al U.S. Pat. No. 3,790,386.

The grain size distribution of the silver halide emulsions can be controlled by silver halide grain separation techniques or by blending silver halide emulsions of differing grain sizes. The emulsions can include ammoniacal emulsions, as illustrated by Glafkides, *Photographic Chemistry,* Vol. 1, Fountain Press, London, 1958, pages 365–368 and pages 301–304; thiocyanate ripened emulsions, as illustrated by Illingsworth U.S. Pat. No. 3,320,069; thioether ripened emulsions as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and Research Disclosure, Vol. 134, June 1975, Item 13452.

The silver halide emulsion can be unwashed or washed to remove soluble salts. The soluble salts can be removed by chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pages 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS No. 2,436,461 and Bolton U.S. Pat. No. 2,495,918 or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152.

For high contrast photographic applications high levels of photographic speed are not necessarily required. Thus, the emulsions employed need not be chemically sensitized. Sensitization with one or more middle chalcogens, sulfur, selenium, and/or tellurium, is a preferred surface chemical sensitization. Such sensitization can be achieved by the use of active gelatin or by the addition of middle chalcogen sensitizers, such as disclosed by *Research Disclosure* Item 17643, cited above, Section III. Reduction and other conventional chemical sensitization techniques disclosed therein which do not unacceptably reduce contrast can also be employed.

Spectral sensitization of the high contrast silver halide emulsions is not required, but can be undertaken using conventional spectral sensitizers, singly or in combination, as illustrated by *Research Disclosure,* Item 17643, cited above Section IV. For black-and-white imaging orthochromatic and panchromatic sensitizations are frequently preferred.

Preferred dyes are cyanine and merocyanine dyes. Emulsions containing cyanine and merocyanine dyes have been observed to exhibit relatively high contrasts. Spectral sensitizing dyes specifically preferred for use in the practice of this invention are as follows:

SS-1: Anhydro-5,5′-dichloro-9-ethyl-3,3′-bis(3-sulfopropyl)oxacarbocyanine hydroxide, sodium salt SS-2: 5,5′,6,6′-Tetrachloro-1,1′,3,3′-tetraethylbenzimidazolocarbocyanine iodide SS-3: 3,3′-Diethyl-9-methylthiacarbocyanine bromide SS-4: 3,3-Diethyloxacarbocyanine iodide SS-5: 5,5′-Dichloro-3,3′,9-triethylthiacarbocyanine bromide SS-6: 3,3′-Diethylthiocarbocyanine iodide SS-7: 5,5′-Dichloro-2,2′-diethylthiocarbocyanine, p-toluene sulfonate salt SS-8: 3-Carboxymethyl-5-[(3-methyl-2-thiazolidinylidene)-2-methylethylidene]rhodanine SS-9: 3-Ethyl-3-[(3-ethyl-2-thiazolidinylidene)-2-methylethylidene]rhodanine SS-10: 5-[(3-{2-Carboxyethyl}-2-thiazolidinylidene)ethylidene]-3-ethylrhodanine SS-11: 1-Carboxymethyl-5-[(3-ethyl-2-benzothiazolinylidene)ethylene]-3-phenyl-2-thiohydantoin SS-12: 1-Carboxymethyl-5-[(1-ethyl-2(H)-naphtho{1,2-d}thiazolin-2-ylidene)ethylidene]-3-phenyl-2-thiohydantoin SS-13: 3-Carboxymethyl-5-[(3-ethyl-2-benzothiazolinylidene)ethylidene]rhodanine SS-14: 5-[(3-Ethyl-2-benzoxazolinylidene)ethylidene]-3-heptyl-2-thio-2,4-oxazolidinedione SS-15: 3-Carboxymethyl-5-(3-ethyl-2-benzothiazolinylidene)rhodanine SS-16: 3-Carboxymethyl-5-(3-methyl-2-benzoxazolinylidene)rhodanine SS-17: 3-Ethyl-5-[(3-ethyl-2-benzoxazolinylidene)ethylidene]rhodanine The photographic elements of this invention include an arylhydrazide, either in the silver halide emulsion layer described above, or in an adjacent hydrophilic colloid layer. Any arylhydrazide known to be effective in achieving high contrast negative silver images can be employed. Suitable arylhydrazides are disclosed in R-2, R-5, R-10, R-11, and R-12, cited above, and in Takada et al U.S. Pat. Nos. 4,168,977 and 4,224,401, Okutsu et al U.S. Pat. No. 4,221,857, and Mifune et al U.S. Pat. Nos. 4,243,739 and 4,272,614.

The arylhydrazides can be incorporated in the silver halide emulsion or other hydrophilic colloid layers of the photographic elements of this invention in any effective concentration up to the limit of their solubility. Generally no advantage is realized from introducing concentrations above about $10^{-2}$ mole per mole of silver. Concentration of levels of at least $10^{-3}$ mole per mole of silver are generally employed. An optimum concentration range for high halftone dot quality is from above about $1.5\times10^{-3}$ to $2\times10^{-3}$ mole per mole of silver.

Combinations of arylhydrazides can be employed to optimize performance for specific applications. In a specifically preferred form of the invention an unballasted arylhydrazide is employed in combination with a ballasted arylhydrazide. While the ballasted and unballasted arylhydrazides together satisfy the concentration levels noted above, a preferred minimum concentration of the unballasted arylhydrazide is $5\times10^{-4}$ mole per mole of silver.

The ballasted arylhydrazides include one or more ballasting moieties for the purpose of restricting mobility. The ballasting moieties are typically aryl ring substituents. Ballasted arylhydrazides, though restricted in their mobility, are not confined to silver halide grain surfaces and are to be distinguished from arylhydrazides having a silver halide grain adsorption promoting moiety, such as a thiocarbonyl moiety.

Suitable ballasting groups can take conventional forms. For example, the ballasting groups can be similar to those found in common incorporated couplers. Ballasting groups are generally recognized to require at least 8 carbon atoms and frequently contain 30 or more carbon atoms. The ballast groups typically contain aliphatic and/or aromatic groups that are relatively unreactive, such as alkyl, alkoxy, amido, carbamoyl, oxyamido, carbamoyloxy, carboxy, oxycarbonyl, phenyl, alkylphenyl, phenoxy, alkylphenoxy, and similar groups, with individual ballasts frequently being comprised of combinations of these groups. Ballasted arylhydrazides, though restricted in mobility, retain sufficient residual mobility to promote infectious development.

Unballasted arylhydrazides can be selected from known arylhydrazides which contain neither ballasting substituents nor groups promoting adsorption to silver halide grain surfaces. Typically the aryl moiety of the arylhydrazide is unsubstituted or substituted with lower molecular weight moieties, such as groups chosen from the same substituent categories as the ballasting groups above, but of less than 8 carbon atoms.

Preferred unballasted arylhydrazides within the contemplation of the present invention can be represented by the following formula:

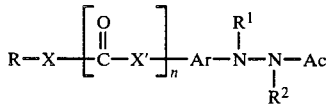

(III)

wherein

Ac represents an activating group;

Ar represents a divalent aromatic group;

n is zero or 1;

R represents an aliphatic or aromatic residue;

$R^1$ and $R^2$ can be either hydrogen or a sulfinic acid radical substituent, with the proviso that only one can be a sulfinic acid radical substituent; and X and X' each represent —NH— or one represents —NH— and the other represents a divalent chalcogen.

A variety of activating groups are described in R-2, cited above. Preferred activating groups are acyl groups. Specifically preferred acyl groups can be represented by the formula:

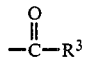

(IV)

where $R^3$ is hydrogen or an aliphatic or aromatic moiety. The highest activity levels are achieved when $R^3$ is hydrogen. In another preferred form $R^3$ can take the form of an alkyl group, with lower alkyl groups of from 1 to 3 carbon atoms being preferred, since activity for corresponding arylhydrazides generally declines as the number of carbon atoms forming the alkyl group increases. When $R^3$ is an aromatic moiety, it is preferably a phenyl group.

The divalent aromatic moiety Ar performs a stabilizing function by providing a direct linkage of the $\beta$ nitrogen atom of the hydrazide to a tertiary carbon atom. In a preferred form the divalent aromatic moiety is a carbocyclic aromatic moiety—i.e., an arylene moiety, such as phenylene or naphthalene. In addition to the preferred aryl substituent group represented in formula (III), the arylene moiety can be further ring substituted at any remaining available position. Examples of other useful substituents include hydroxy, amino, carboxy, alky, alkoxy, halo, and haloalkyl. As herein defined cycloalkyl is subsumed within alkyl moieties. Unless otherwise stated, all aliphatic and aromatic moieties referred to are understood to contain fewer than 8 carbon atoms. When Ar is a phenylene group, it can take the form of an o-, p-, or m-phenylene group, but it is most preferably a p-phenylene group with any additional substituents, if present, being preferably ortho substituents.

R can take the form of an aliphatic or aromatic residue. R should be chosen to retain mobility of the arylhydrazide in a silver halide emulsion or hydrophilic colloid layer of a photographic element. In one form R can be an arylhydrazide. For example, it can take any of the forms of the arylhydrazide shown to the right of X' in formula (III). In a specifically preferred form R is an alkyl group, optimally an alkyl group containing from 2 to 6 carbon atoms. In an aromatic form R is preferably phenyl. Five and six member heterocyclic ring containing aromatic residues are also contemplated, such as pyridyl, thiazolyl, oxazolyl, and imidazolyl groups.

$R^1$ and $R^2$ are preferably hydrogen. It has been recognized that when one of the nitrogen atoms of the hydrazino moiety is displaced by a sulfinic acid radical substituent, preferably an arylsulfonyl group, an increase in photographic speed can be realized. As between $R^1$ and $R^2$ it is preferred that $R^1$ be a sulfinic acid radical substituent. However, photographic speeds fully acceptable for halftone imaging applications can be readily achieved in the absence of a sulfinic acid radical substituent attached to either of the nitrogen atoms $\alpha$ or $\beta$ to the Ac moiety in formula (III), and overall characteristic curve shape in the toe and shoulder regions is generally superior in the absence of the sulfinic acid radical substituent.

When n is 1, one of X and X' each represent —NH— or one presents —NH— and the other represents a divalent chalcogen (e.g., an oxy or thio linking atom). In one specifically preferred form both X and X' represent —NH—. When X is —NH—, X' can be chosen to complete a carbamoyloxy (—NH—C(O)—O—) or carbamoylthio (—NH—C(O)—S—) group. In a specifically preferred form of the invention X' is represented by —NH— and X completes a thiocarbamido (—S—C(O)—NH—) and, most preferably, an oxycarbamido (—O—C(O)—NH—) group.

When n is zero, X completes with R an oxy, thio, or amino substituent.

Specifically preferred arylhydrazides according to the present invention can be represented by the following formula:

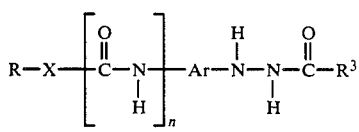

(V)

where

Ar is a phenylene, preferably a p-phenylene, group;

n is zero or 1;

R is alkyl of from 1 to 8 carbon atoms, preferably 2 to 6 carbon atoms, or a phenyl substituent;

$R^3$ is hydrogen, lower alkyl of from 1 to 3 carbon atoms, or phenyl; and

X is —O— when n is zero and —O— or —NH— when n is 1.

In one specifically preferred form the unballasted arylhydrazide is characterized by the aryl moiety being substituted with an alkoxy group containing less than 8 carbon atoms, such as a methoxy, ethoxy, propoxy, or hexoxy aryl substituent.

In another specifically preferred form the unballasted arylhydrazide takes the form disclosed in Loblaw et al U.S. Ser. No. 658,921, filed Oct. 9, 1984.

In still another specifically preferred form the unballasted arylhydrazide takes the form of an alkylureido substituted arylhydrazide, such as disclosed in Mifune U.S. Pat. No. 4,323,643.

The following are illustrative of specific arylhydrazides within the contemplation of this invention:

AH-1: 2-(2,6-dichloro-4-methoxycarbamidophenyl)-1-propionylhydrazine

AH-2: 2-(4-ethylcarbamoyloxyphenyl)-1-formylhydrazine

AH-3: 2-(4-ethoxycarbamoylthiophenyl)-1-formylhydrazine

AH-4: 2-(4-ethoxycarbamidophenyl)-1-formylhydrazine

AH-5: 2-(4-ethoxycarbamidophenyl)-1-formyl-2-p-tosylhydrazine
AH-6: 1-acetyl-2-(4-propylureidophenyl)hydrazine
AH-7: 2-(4-butoxycarbamidophenyl)-1-formylhydrazine
AH-8: 2-(4-butylthiocarbamidophenyl)-1-formylhydrazine
AH-9: 2-(4-butylcarbamoyloxyphenyl)-1-formylhydrazine
AH-10: 1-benzoyl-2-(4-butylcarbamoylthio-2-trifluoromethylphenyl)hydrazine
AH-11: 1-benzoyl-2-(2-pentylureidophenyl)hydrazine
AH-12: 1-formyl-2-(4-iso-propoxycarbamidophenyl)hydrazine
AH-13: 1-formyl-2-(4-hexylureidophenyl)hydrazine
AH-14: 1-formyl-2-(4-phenoxycarbamidophenyl)hydrazine
AH-15: 1-formyl-2-(2-methoxy-4-N-pyridyloxycarbamidophenyl)hydrazine
AH-16: 2-(2-N,N-diethylamino-4-phenylthiocarbamidophenyl)-1-formylhydrazine
AH-17: 2-(2,6-dichloro-4-methoxyphenyl)-1-propionylhydrazine
AH-18: 2-(4-ethoxyphenyl)-1-formyl-2-p-tosylhydrazine
AH-19: 1-acetyl-2-(4-propoxyphenyl)hydrazine
AH-20: 2-(4-butoxyphenyl)-1-formylhydrazine
AH-21: 2-(4-butylaminophenyl)-1-formylhydrazine
AH-22: 1-benzoyl-2-(2-pentylthio)phenylhydrazine
AH-23: 1-formyl-2-(4-iso-propoxyphenyl)hydrazine
AH-24: 1-formyl-2-(4-hexoxyphenyl)hydrazine
AH-25: 1-formyl-2-(4-phenoxyphenyl)hydrazine The photographic elements can be protected against fog by incorporation of antifoggants and stabilizers in the element itself or in the developer in which the element is to be processed. Conventional antifoggants, such as those disclosed by Mifune et al U.S. Pat. Nos. 4,241,164, 4,311,781, 4,166,742, and 4,237,214, and Okutsu et al U.S. Pat. No. 4,221,857, can be employed.

Preferred antifoggants are benzotriazoles, such as benzotriazole (that is, the unsubstituted benzotriazole compound), halo-substituted benzotriazoles (e.g., 5-chlorobenzotriazole, 4-bromobenzotriazole, and 4-chlorobenzotriazole), and alkyl-substituted benzotriazoles wherein the alkyl moiety contains from about 1 to 12 carbon atoms (e.g., 5-methylbenzotriazole). Other known useful antifoggants include benzimidazoles, such as 5-nitrobenzimidazoles; benzothiazoles, such as 5-nitrobenzothiazole and 5-methylbenzothiazole; heterocyclic thiones, such as, 1-methyl-2-tetrazoline-5-thione; triazines, such as 2,4-dimethylamino-6-chloro-5-triazine; benzoxazoles, such as ethylbenzoxazole; and pyrroles, such as 2,5-dimethylpyrrole.

The antifoggants can be employed in conventional concentrations. The benzotriazole can be located in the emulsion layer or in any hydrophilic colloid layer of the photographic element in a concentration in the range of from $10^{-4}$ to $10^{-1}$, preferably $10^{-3}$ to $3\times10^{-2}$, mole per mole of silver. When the benzotriazole antifoggant is added to the developer, it is employed in a concentration of from $10^{-6}$ to about $10^{-1}$, preferably $3\times10^{-5}$ and $3\times10^{-2}$, mole per liter of developer.

In addition to the components of the photographic emulsions and other hydrophilic colloid layers described above it is appreciated that other conventional element addenda compatible with obtaining relatively high contrast silver images can be present. For example, the photographic elements can contain development modifiers, plasticizers and lubricants, coating aids, antistatic materials, and matting agents, these conventional materials being illustrated in *Research Disclosure,* cited above, Item 17643, Sections XII, XIII, and XVI. The elements can be exposed as described in Section XVIII.

The light sensitive silver halide contained in the photographic elements can be processed following exposure to form a relatively high contrast image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973, *Photo-Lab Index* Morgan and Morgan, Inc., Dobbs Ferry, N.Y. 1977; and *Neblette's Handbook of Photographic and Reprographic Materials, Processes and Systems,* VanNostrand Reinhold Company, 7th Ed., 1977.

It is a distinct advantage of the present invention that the photographic elements can be processed in conventional developers generally as opposed to specialized developers conventionally employed in conjunction with lith photographic elements to obtain very high contrast images. When the photographic elements contain incorporated developing agents, the elements can be processed in an activator, which can be identical to the developer in composition, but lacking a developing agent. Very high contrast images can be obtained at pH values in the range of from 10.5 to 13.0, preferably 11 to 12.5. It is also an advantage of this invention that relatively high contrast images can be obtained with higher concentrations of preservatives to reduce aerial oxidation of the developing agents, such as alkali sulfites (e.g., sodium or potassium sulfite, bisulfite or metasulfite) than has heretofore been feasible in traditional lith processing. This allows the developers to be stored for longer periods. Any preservative or preservative concentration conventional in lower contrast processing can be employed, such as, for instance, a sulfite ion concentration in the range of from about 0.15 to 1.2 mole per liter of developer.

The developers are typically aqueous solutions, although organic solvents, such as diethylene glycol, can also be included to facilitate the solvency of organic components. The developers contain one or a combination of conventional developing agents, such as polyhydroxybenzene, aminophenol, para-phenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Also, chelating and sequestering agents, such as ethylenediaminetetraacetic acid or its sodium salt, can be present. Generally, any conventional developer composition can be employed in the practice of this invention. Specific illustrative photographic developers are disclosed in the *Handbook of Chemistry and Physics,* 36th Edition, under the title "Photographic Formulae" at page 3001 et seq., and in *Processing Chemicals and Formulas,* 6th Edition, published by Eastman Kodak Company (1963), the disclosures of which are here incorporated by reference. The photographic elements can, of course, be processed with conventional developers for lith photographic elements, as illustrated by Masseth U.S. Pat. No. 3,573,914 and VanReusel U.K. Pat. No. 1,376,600. A preferred developer is disclosed by Nothnagle U.S. Pat. No. 4,269,929.

EXAMPLES

The invention can be better appreciated by reference to the following specific examples:

Example 1

Coating 1a (Control)

A cubic bromoiodide emulsion (2.7 mole % iodide; mean grain size about 0.25 μm) was coated on a polyester support at 3.50 g/m$^2$Ag and 2.48 g/m$^2$ gelatin, and contained the spectral sensitizing dye anhydro-5,5'-dichloro-9-ethyl-3,3'-bis(3-sulfopropyl)oxacarbocyanine hydroxide, triethylamine salt at 216 mg/Ag mole, the nucleating agents 1-formyl-2-{4-[2-(2,4-di-tert-pentylphenoxy)butyramido]phenyl}hydrazine at 373 mg/Ag mole; and 1-[4-(2-formylhydrazino)phenyl]-3-hexylurea at 72 mg/Ag mole; and the addenda oleic ether of polyethylene glycol (m.w. 1540) at 250 mg/Ag mole; 4-hydroxy-6-methyl-1,3,3a,7-tetraazaindene sodium salt at 1 g/Ag mole; and a latex copolymer of methyl acrylate, 2-acrylamido-2-methylpropanesulfonic acid, sodium salt, and 2-acetoacetoxyethyl methacrylate (88:5:7 wt. ratio) at 34 g/Ag mole. The emulsion was overcoated with 1.38 g/m$^2$ gelatin. The layers were hardened with bis(vinylsulfonylmethyl) ether at 4.9% of the total weight of gelatin.

Coating 1b (Invention)

Coating 1b was prepared similarly as Coating 1a, except that $3.0\times10^{-4}$ mole/Ag mole of 4-carboxymethyl-3H-thiazoline-2-thione (ST-1) and $4.3\times10^{-2}$ mole/Ag mole of hydroquinone (PHB-1) were added to the emulsion layer.

Coating 1c (Invention)

Coating 1c was prepared similarly as Coating 1b, but with the further addition of 4,5-dihydroxy-1,3-benzenedisulfonic acid, disodium salt (PHB-10) at $1.0\times10^{-2}$ mole/Ag mole.

Coating 1d (Control)

Coating 1d was prepared similarly as Coating 1b, but PHB-1 was omitted.

The coatings were exposed on a Kodak ® Sensitometer, Model 1B (10s, pulsed Xenon source). Sensitometric data were determined after development in a fresh developer of the type disclosed in Nothnagle U.S. Pat. No. 4,269,929 for 80 sec. at 30° C. using a roller transport processor. Pepper fog determinations were made after processing in fresh developer for 80 sec. at 30° C. (A); processing in seasoned developer for 80 sec. at 30° C. (B); and processing in seasoned developer for 33 sec. at 38° C. in two different processing apparatuses (C) and (D). The pepper fog level was evaluated by visual rating versus a reference scale of from 1 to 10, with 10 being the most severe. FIG. 1 represents a rating of 10 on the reference scale while FIG. 2 represents a reference scale rating of 5. Lower reference scale figures are not provided, since pepper fog requirements are more stringent than consistently observed in patent figure printing. The results are tabulated in Table I.

TABLE I

| Coating | Relative Speed | Upper Scale Contrast | Pepper Fog Rating A | B | C | D |
|---|---|---|---|---|---|---|
| 1a (Control) | 100 | 9.9 | 2 | 2 | 4 | 3 |
| 1b (Inv.) | 107 | 10.0 | 2 | 1 | 2 | 2 |
| 1c (Inv.) | 110 | 9.6 | 1 | 1 | 3 | 2 |
| 1d (Control) | 87 | 6.5 | 1 | 1 | 3 | 2 |

The data in Table I show that the addition of ST-1 and PHB-1 (Coating 1b) reduced pepper fog experienced with seasoned developer without loss of sensitivity or contrast. With PHB-10 added, Coating 1c, pepper fog using fresh developer was assigned the lowest possible rating. Similar pepper fog characteristics were observed in Coating 1d, which lacked any polyhydroxybenzene, but contrast was objectionably lower to well below high contrast levels.

The invention has been described in detail with particular reference to preferred embodiments thereof, but it will be understood that variations and modifications can be effected within the spirit and scope of the invention.

What is claimed is:

1. A negative working photographic element capable of producing a high contrast silver image comprised of a support, a contrast enhancing arylhydrazide, and a gelatino-silver halide emulsion layer comprised of surface latent image forming monodispersed silver halide grains having a mean diameter of less than 0.7 μm, further characterized in that said emulsion layer contains in an amount sufficient to reduce pepper fog while maintaining high contrast a polyhydroxybenzene and a carboxyalkyl-3H-thiazoline-2-thione.

2. A photographic element according to claim 1 in which said silver halide grains are of a cubic crystallographic form.

3. A photographic element according to claim 1 in which said emulsion is a silver bromide emulsion optionally containing a minor proportion of iodide.

4. A photographic element according to claim 1 in which said silver halide grains are sensitized.

5. A photographic element according to claim 4 in which said a spectral sensitizing dye is adsorbed to the surface of said silver halide grains.

6. A photographic element according to claim 4 in which said silver halide grains are surface sulfur sensitized.

7. A photographic element according to claim 4 in which said silver halide grains contain a Group VIII noble metal as an internal dopant.

8. A photographic element according to claim 1 in which said emulsion layer additionally contains a latex vehicle.

9. A photographic element according to claim 1 in which said polyhydroxybenzene is a catechol.

10. A photographic element according to claim 1 in which said polyhydroxybenzene is a resorcinol.

11. A photographic element according to claim 1 in which said polyhydroxybenzene is a hydroquinone.

12. A photographic element according to claim 11 in which said hydroquinone is unsubstituted or only sulfo substituted and present in a concentration of less than $5\times10^{-2}$ mole per silver mole.

13. A photographic element according to claim 1 in which said alkyl moiety of said carboxyalkyl substituent contains from 1 to 6 carbon atoms.

14. A photographic element according to claim 13 in which said carboxyalkyl substituent contains an alkylene linking moiety of from 1 to 3 carbon atoms.

15. A photographic element according to claim 13 in which said carboxyalkyl substituent contains an optionally alkyl substituted methylene linking moiety.

16. A photographic element according to claim 15 in which said methylene linking moiety is a —$CH_2$— moiety.

17. A photographiIc element according to claim 1 in which said emulsion layer contains 4-carboxymethyl-3H-thiazoline-2-thione.

18. A photographic element according to claim 12 in which said emulsion layer contains said 4-carboxymethyl-3H-thiazoline-2-thione in a concentration of from $3\times10^{-5}$ to $3\times10^{-3}$ mole per silver mole.

* * * * *